US005859503A

United States Patent [19]

Potratz

[11] Patent Number: 5,859,503

[45] Date of Patent: Jan. 12, 1999

[54] LAMP MODULATION CIRCUIT HAVING A FEEDBACK FOR MEASURING LAMP TEMPERATURE

[75] Inventor: Robert Stephen Potratz, Overland Park, Kans.

[73] Assignee: Nellcor Puritan-Bennett, Pleasanton, Calif.

[21] Appl. No.: 831,201

[22] Filed: Apr. 2, 1997

[51] Int. Cl.[6] ..... H05B 37/02

[52] U.S. Cl. ..... 315/291; 315/224; 315/307; 315/309

[58] Field of Search ..... 315/307, 224, 315/209 R, 219, 225, 200 R, 291, 94, 119, 309

[56] References Cited

U.S. PATENT DOCUMENTS 4,902,958 2/1990 Cook ..... 323/282

*Primary Examiner*—Don Wong
*Assistant Examiner*—David H. Vu
*Attorney, Agent, or Firm*—Hovey, Williams, Timmons & Collins

[57] ABSTRACT

A lamp drive circuit periodically energizes a lamp above its rated voltage and current for rapid illumination of the lamp. In the preferred embodiment, the lamp is connected in a voltage divider and the circuit monitors the voltage drop across the lamp. The voltage drop is indicative of the lamp resistance and thereby the temperature. When the voltage drop reaches a predetermined limit corresponding to the temperature rating of the lamp, it is de-energized and allowed to cool during the remainder of the cycle thereby enabling a high modulation frequency.

11 Claims, 1 Drawing Sheet

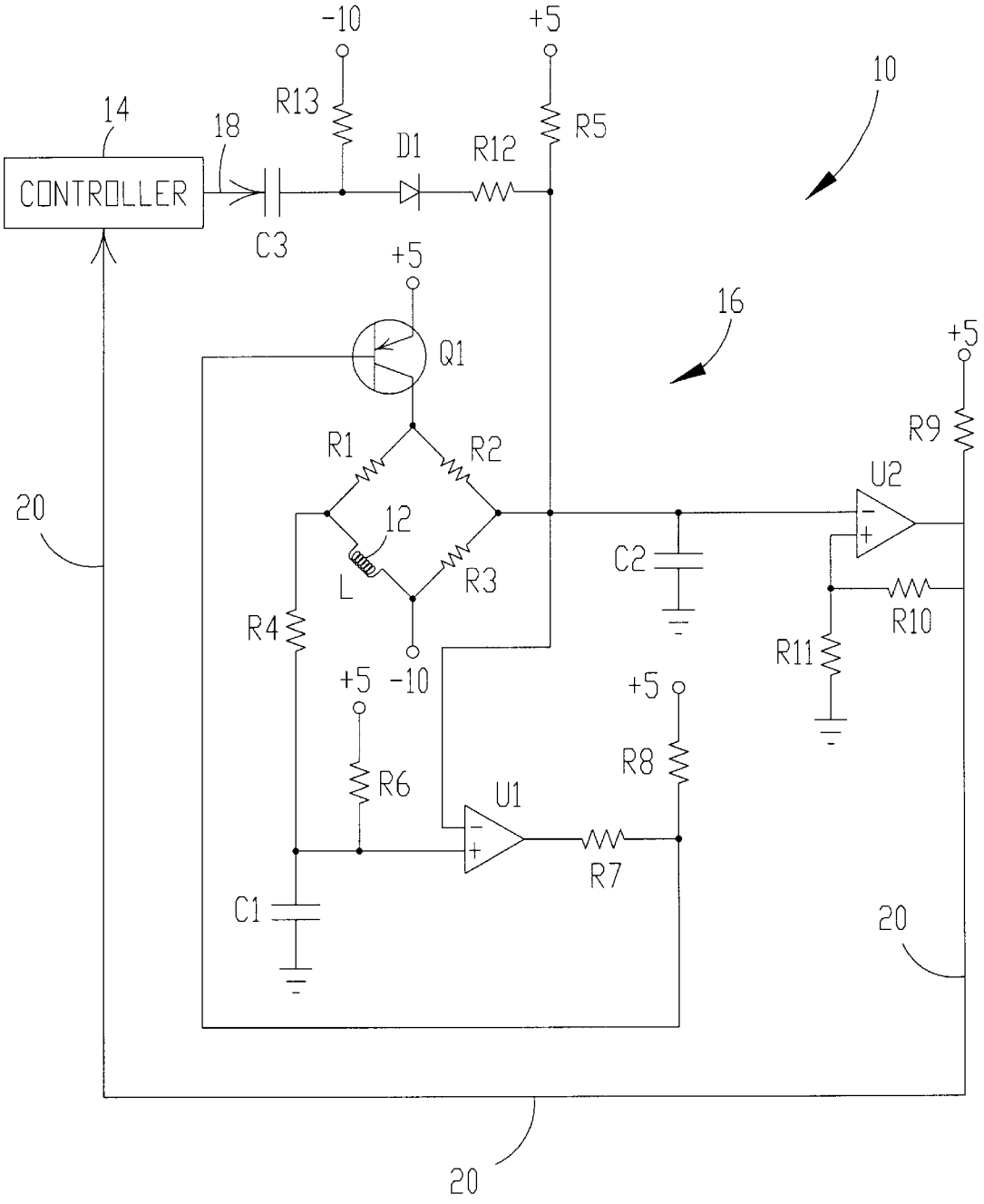
-10
+5
10
14
18
R13
D1
R12
R5
CONTROLLER
C3
+5
16
Q1
+5
R9
R1
R2
U2
20
12
C2
L
R3
R10
R4
R11
+5
-10
+5
R8
R6
U1
R7
C1
20
20

LAMP MODULATION CIRCUIT HAVING A FEEDBACK FOR MEASURING LAMP TEMPERATURE

BACKGROUND OF THE INVENTION

1. Field of the Invention

The present invention is concerned with a lamp drive circuit that periodically energizes a lamp above its rated voltage and current for rapid illumination of the lamp. More particularly, the invention is concerned with a circuit in which the lamp is connected in a voltage divider and the circuit monitors the voltage drop across the lamp. The voltage drop is indicative of lamp resistance and thereby temperature. When the voltage drop reaches a predetermined limit corresponding to the temperature rating of the lamp, it is de-energized and allowed to cool during the remainder of the cycle thereby enabling a high modulation frequency.

2. Description of the Prior Art

Some measuring instruments measure the absorption or transmittance of certain light wavelenghts from a light source as a measure of a parameter of interest such as carbon dioxide. In order to eliminate the effects of ambient light and other noise components, the light from the light source is modulated, which allows filtering of DC inaccuracies. Such modulation is typically accomplished by using a mechanical, rotating filter wheel. Such mechanisms are relatively expensive, bulky and prone to mechanical failure.

Electronic modulation of the light source itself would eliminate the need for mechanical modulation, but available solid state devices such as LEDs and laser diodes cannot produce some needed frequencies such as the 4.2 uMeter wavelength necessary for carbon dioxide detection. A standard tungsten filament lamp can provide needed wavelengths but cannot be modulated electronically with a high enough modulation frequency because of the long thermal time constant of the filament.

SUMMARY OF THE INVENTION

The present invention solves the prior art problems discussed above and provides a distinct advance in the state of the art. More particularly, the lamp control circuit hereof allows electronic modulation of a lamp at high modulation frequencies.

The preferred circuit includes a lamp connected in a voltage divider, a controller for selectively producing an activation signal at the desired modulation frequency, and an activation circuit responsive to the activation signal for activating the lamp. The activation circuit includes an energizing circuit for energizing the lamp by imposing a voltage across the divider greater than the rated voltage of the lamp for producing a current greater than the rated current of the lamp. This rapidly illuminates the lamp in order to overcome the long thermal time constant.

The activation circuit also includes a sensing circuit for sensing the voltage drop across the lamp which corresponds to a resistance limit and thereby the temperature limit of the lamp. When the temperature limit is reached, the lamp is de-energized and allowed to cool during the remainder of the modulation cycle. Other preferred aspects of the invention are discussed herein.

BRIEF DESCRIPTION OF THE DRAWINGS

The single drawing FIGURE is an electrical schematic of the lamp control circuit of the present invention.

DETAILED DESCRIPTION OF THE PREFERRED EMBODIMENT

Preferred lamp control circuit 10 includes lamp 12, controller 14 and activation circuit 16. Lamp 12 is preferably an incandescent lamp operable to produce the desired wavelengths of light when energized. In the example hereof, lamp 12 includes a tungsten filament and has a rated voltage of about 5 volts and a rated current of about 110 ma. These ratings correspond to a rated resistance limit of about 45.45 ohms (5V÷110 ma). When de-energized and cold, lamp 12 presents a resistance of about 2 ohms. When lamp 12 is energized, the lamp resistance increases as filament temperature increases. Accordingly, lamp resistance can be used as a measure of filament temperature.

Controller 14 is preferably any device that can produce activation signals as needed for a particular application. Such a device can include a microprocessor, microcontroller, microcomputer, a flip-flop, or the like. In the preferred embodiment, controller 14 produces periodic activation or "start" signals on line 18 at a desired modulation frequency. These activation signals are preferably in the form of square wave or analog pulses. Controller 14 also receives enable or "ready" signals on line 20.

Activation circuit 16 includes comparator U1 (LP365), comparator U2 (LP365), transistor Q1 (HPSA56) and selected resistors and capacitors connected as illustrated in the drawing FIGURE. Supply voltage, Vcc, is provided at +5 VDC.

Comparator U1 is connected across a bridge with one side including a voltage divider composed of resistor R1 (6.8 ohms) in series with lamp 12, and another voltage divider composed of resistor R2 (4.7K) in series with resistor R3 (31.6K). The junction between R1 and lamp 12 is connected to the noninverting (+) terminal of U1 by way of resistor R4 (4.75K) with capacitor C1 (0.022 uF) also connected to this terminal to provide noise filtering and to provide a slight signal delay for loop stability. The junction between R2 and R3 is connected to the inverting (−) terminal of U1 with capacitor C2 (0.022 uF) also connected to this terminal for filtering.

In operation, with Q1 off, lamp 12 cool and no activation signal on line 18, current is supplied from Vcc through resistor R5 (274K) and then splits through two paths. The first path is R2, R1 and lamp 12 to the negative supply (−10 VDC), and the other path is through R3. This provides a voltage to the inverting terminal of U1 slightly above −10 VDC. For the noninverting terminal of U1, current is supplied from Vcc through resistor R6 (274K), R4 and lamp 12 to the negative supply at −10 VDC.

The various resistance values are such that the voltage on the noninverting terminal (+) is slightly greater than the voltage on the inverting terminal (−). As a result, the output of comparator U1 is off by way of resistor R7 (475 ohms). Vcc pulls up the output of U1 to +5 by way of resistor R8 (332K) to the base of Q1, keeping this transistor turned off.

The junction between R2 and R3 is also connected to the inverting terminal (−) of comparator U2 and presents a voltage slightly above −10 VDC. Current is supplied from Vcc through resistors R9 (4.75K), R10 (1.0M) and R11 (10.0K) to ground. The voltage drop across R11 is supplied to the noninverting terminal (+) of U2 at a small positive value. With lamp 12 cool, the voltage on the inverting terminal (−) is lower than the noninverting terminal (+) and the output from U2 is off. This allows Vcc to pull up the voltage on line 20 to +5V as an enable signal or "ready" signal indicating to controller 14 that lamp 12 has cooled below the temperature limit.

In the preferred embodiment, controller 14 operates to provide an activation signal or start signal on line 18 in the form of a pulse. Capacitor C3 (0.01 uF) transmits this pulse but blocks any DC component. In this way, if controller 14 would fail and provide a continuous signal on line 18, capacitor C3 would prevent continuous activation of lamp 12 as a result.

The activation signal is provided by way of diode D1 and resistor R12 (22.1K) to the inverting terminal of U1. In the absence of an activation signal, diode D1 is reversed biased at −10 VDC by way of resistor R13 (100K).

The activation signal increases the voltage on the inverting terminal (−) of U1 to a level greater than the noninverting terminal. As a result, U1 turns on and sinks current from the base of Q1, which also turns on.

Vcc at +5 and negative supply at −10 are then connected to the bridge thereby imposing a voltage of 15 volts across the divider made up of R1 and lamp 12. This drives lamp 12 at a voltage higher than the rated voltage of 5 volts and at a current higher than the rated current of 110 ma. As a consequence, the filament of lamp 12 rapidly heats and thereby, rapidly illuminates. The voltage drop across lamp 12 is supplied by way of R4 to the noninverting terminal (+) of U1.

Q1 also provides Vcc supply to the other half of the bridge made up of R2 and R3. The voltage drop across R3 is provided to the inverting terminal (−) of U1. This keeps U1 and thereby Q1 turned on after the activation signal ends.

As the filament of lamp 12 heats, its resistance increases and approaches the rated resistance of about 45.45 ohms at the rated temperature limit. As the filament resistance increases, the voltage drop across lamp 12 increases as does the voltage on the noninverting terminal of U1. The various resistance values are such that when the resistance of lamp 12 reaches the resistance limit of 45.45 ohms, the voltage drop across lamp 12 imposed on the noninverting terminal (+) of U1 equals the voltage on the inverting terminal (−), that is, the bridge is balanced. When this occurs, U1 turns off as does Q1, thereby de-energizing lamp 12. In this way, the components of activation circuit 16 function as means for energizing lamp 12 in response to the activation signal, and also as means for sensing when the lamp reaches the temperature limit and de-energizing lamp 12 in response.

Thus, even though lamp 12 is initially energized at higher than rated levels, it is de-energized before the temperature of the filament exceeds the rated temperature. This enables the modulation of lamp 12 at a higher frequency than conventional square wave modulation. Additionally, lamp life is extended because it is de-energized upon reaching rated temperature and does not experience sustained operation at this temperature.

After Q1 turns off, comparator U2 continues to monitor the status of lamp 12 by sensing the voltage drop across resistors R2, R1 and lamp 12 as supplied by Vcc through R5. As lamp 12 turns off, U2 turns on and supplies the ready signal over line 20 to controller 14 indicating that lamp 12 is ready for another cycle.

Comparator U2 can also indicate whether lamp 12 is burned out. An open filament simulates a high resistance and U2 fails to turn on and fails to supply the ready signal, which indicates that lamp 12 is defective.

Having thus described the preferred embodiment of the present invention, the following is claimed as new and desired to be secured by Letters Patent:

I claim:

1. A lamp control circuit comprising:

a lamp having a rated voltage and rated current cooperatively defining an electrical resistance limit corresponding to a temperature limit;

control means for selectively producing an activation signal; and activation means electrically coupled with said lamp and control means for selectively activating said lamp including energizing means coupling said lamp in a voltage divider for energizing said lamp and thereby illuminating said lamp in response to said activation signal by imposing a voltage across said lamp greater than said rated voltage for producing a current greater than said rated current through said lamp, and sensing means for sensing the voltage drop across said lamp and for de-energizing said lamp when said voltage drop reaches a predetermined level corresponding to said resistance limit and thereby said temperature limit, said activation means including feedback means for determining when the temperature of said lamp is below said temperature limit by determining when said voltage drop falls below said resistance limit and responsive thereto for producing a ready signal representative thereof, said control means including means for producing a plurality of successive activation signals and thereby a plurality of successive illuminations of said lamp wherein each successive activation signal is subsequent to said lamp being de-energized by said sensing means, and means for receiving said ready signal and responsive thereto for enabling production of the next of said activation signals, said activating means including a bridge circuit including said voltage divider as a first voltage divider and including a second voltage divider, said feedback means including a comparator coupled with said bridge for comparing a voltage drop of said first divider with the voltage drop of said second divider and for producing said ready signal when the voltage drop across said first divider exceeds the voltage drop across said second divider.

2. The circuit as set forth in claim 1, said successive activation signals being periodic thereby modulating the illumination of said lamp at an identifiable frequency.

3. The circuit as set forth in claim 1, said control means including a microprocessor.

4. The circuit as set forth in claim 1, said lamp including an incandescent lamp.

5. The circuit as set forth in claim 1, said activation signal including a pulse.

6. A lamp control circuit comprising:

a lamp having a rated voltage and rated current cooperatively defining an electrical resistance limit corresponding to a temperature limit;

control means for selectively producing an activation signal; and activation means electrically coupled with said lamp and control means for selectively activating said lamp including energizing means coupling said lamp in a voltage divider for energizing said lamp and thereby illuminating said lamp in response to said activation signal by imposing a voltage across said lamp greater than said rated voltage for producing a current greater than said rated current through said lamp, and sensing means for sensing the voltage drop across said lamp and for de-energizing said lamp when said voltage drop reaches a predetermined level corresponding to said resistance limit and thereby said temperature limit, said activating means including a bridge circuit including said voltage divider as a first voltage divider and including a second voltage divider, said sensing means including a comparator coupled with said bridge for comparing a voltage drop of said first divider with the voltage drop of said second divider and for de-energizing said lamp when the voltage drop across said first divider exceeds the voltage drop across said second divider.

7. The circuit as set forth in claim 6, said control means including means for producing a plurality of successive activation signals and thereby a plurality of successive illuminations of said lamp wherein each successive activation signal is subsequent to said lamp being de-energized by said sensing means.

8. The circuit as set forth in claim 7, said successive activation signals being periodic thereby modulating the illumination of said lamp at an identifiable frequency.

9. The circuit as set forth in claim 6, said control means including a microprocessor.

10. The circuit as set forth in claim 6, said lamp including an incandescent lamp.

11. The circuit as set forth in claim 6, said activation signal including a pulse.

* * * * *